US005554909A

United States Patent [19]

Brennesholtz

[11] Patent Number: 5,554,909

[45] Date of Patent: Sep. 10, 1996

[54] ONE DIMENSIONAL TENSION MASK-FRAME ASSEMBLY FOR CRT

[75] Inventor: Matthew S. Brennesholtz, Pleasantville, N.Y.

[73] Assignee: Philips Electronics North America Corporation, New York, N.Y.

[21] Appl. No.: 239,172

[22] Filed: May 6, 1994

[51] Int. Cl.[6] ..... H01J 29/80

[52] U.S. Cl. ..... 313/402; 313/407

[58] Field of Search ..... 313/402, 404, 313/407, 408

[56] References Cited

U.S. PATENT DOCUMENTS

| | | | |
|---|---|---|---|
| 3,638,063 | 1/1972 | Tachikawa et al. | 313/348 |
| 4,327,307 | 4/1982 | Penird | 313/407 |
| 4,333,034 | 6/1982 | Ohgoshi et al. | 313/407 |
| 4,806,820 | 2/1989 | Berner | 313/407 |
| 5,041,756 | 8/1991 | Fairbanks | 313/407 |
| 5,113,111 | 5/1992 | Fairbanks | 313/407 |
| 5,214,349 | 5/1993 | Sakata et al. | 313/407 |

FOREIGN PATENT DOCUMENTS

| | | | |
|---|---|---|---|
| 0228110 | 7/1987 | European Pat. Off. . | |
| 2324811 | 11/1973 | Germany | 313/407 |

*Primary Examiner*—Sandra L. O'Shea
*Assistant Examiner*—Mack Haynes
*Attorney, Agent, or Firm*—John C. Fox

[57] ABSTRACT

A one-dimensional tension mask-frame assembly for a color cathode ray tube includes a rectangular frame whose top and bottom members each have inwardly flexed upstanding portions with a spring constant, and a rectangular mask secured to the frame along the free edges of the upstanding frame portions, the frame portions maintaining the mask in a state of tension during thermal expansion of the mask. The assembly is useful in color display applications such as T.V.

13 Claims, 6 Drawing Sheets

ONE DIMENSIONAL TENSION MASK-FRAME ASSEMBLY FOR CRT

BACKGROUND OF THE INVENTION

This invention relates to an apertured color selection electrode or mask for use in a color cathode ray tube, and more particularly relates to such a mask which is held under mechanical tension.

A common type of color cathode ray tube (CRT) used in color television and allied color display applications such as computers, oscilloscopes, etc., employs an apertured color selection electrode or mask to control passage of the electron beams to the proper locations on the cathodoluminescent display screen.

In the case of television, the CRT employs three electron beams, one for each of the primary color (red, blue and green) components of the color video signal, and employs a screen made up of an array of phosphor elements luminescing in the three primary colors. The apertured mask is located a short distance behind the screen to intercept the electron beams, and has a large number of apertures located to allow passage of each beam to the phosphor elements of the corresponding color.

The mask is fabricated from a relatively thin sheet of metal such as steel, and is thus susceptible to thermal expansion when heated, primarily by impingement of the electron beams. Such expansion moves the mask closer to the screen, which can change the registration of the apertures with the phosphor elements. During an initial warm-up period, the various tube components will expand at various rates, but will eventually come to an approximate state of thermal equilibrium, at which the tube is designed to operate. However, during normal operation, transient heating in localized areas of the mask occurs when the beam intensity is high, for example, to portray highlights in the display on the screen. This localized heating causes a transient localized expansion of the mask known as "doming". This doming can cause mis-registration between the apertures and the phosphor elements, which degrades the color purity of the display.

Various techniques have been employed in an attempt to minimize doming. These include reducing the heating or increasing the cooling of the mask, such as by coating the back of the mask with a material having a high electron back scattering coefficient, to reduce heating of the mask by the electron beams, or by coating the back of the screen with a material having a high thermal emissivity, to conduct heat away from the mask. However, these techniques introduce new materials and add extra steps to the manufacturing process, and tend to decrease luminance and/or contrast of the display.

Another technique is to fabricate the mask from a material having a relatively low thermal expansion, such as an iron-nickel alloy containing about 36 weight percent nickel, balance mostly iron, known commercial by the name Invar. While Invar masks exhibit less doming than conventional steel masks, they are more expensive, due both to higher material cost and to lower yields. More effective in reducing doming is to place the mask under mechanical tension.

Two examples of tension masks in current production are the Sony Trinitron and the Zenith FTM (flat tension mask) tubes. The FTM tube employs a so-called dot screen, in which the phosphor elements are in the form of triads of red, blue and green dots, requiring registration with and tension in both the longitudinal and transverse directions of the mask. The Sony tube uses a more conventional striped screen, in which the phosphor elements are in the form of longitudinally-oriented triads of red, blue and green stripes, and thus requires registration only in the transverse direction.

The Sony mask is a grid structure of grid elements stretched longitudinally over a substantially rectangular, one-piece rigid frame. The grid elements are stretched between the supports of the frame by an amount sufficient that they will remain taut even during heating and expanding. This is accomplished by loading to effect resilient bending of the sides of the frame, securing the grid elements to the top and bottom of the frame, and removing the load, allowing the sides to return to their original positions, thereby causing the desired longitudinal stretching of the grid elements.

Exemplary structures in which the required resilience in the sides of the frame is achieved by the use of resilient U-shaped side supports and by cutting recesses into the sides of the frame are described in U.S. Pat. Nos. 3,638,063 and 4,333,034, respectively. A variation of the latter design in which the recesses are replaced with leaf springs is described in U.S. Pat. No. 5,214,349.

With such structures, changes in tension of the grid elements caused by thermal expansion are compensated for by the shrinkage of the grid elements or by a slight restoring force of the frame (see U.S. Pat. No. 3,638,063, col. 4, lines 18–22).

In a further variation on this theme, described in JP-A 5-114356, both the side supports and the top and bottom members are deformed during assembly, and thereafter provide a restoring force to maintain the grid elements in tension.

Unfortunately, in order to maintain the grid elements in a high degree of tension, such grid structures tend to be relatively heavy and rigid, and require relatively complex and expensive manufacturing techniques to produce. In addition, such rigid structures are less efficient in reducing localized doming than in reducing overall doming.

OBJECTS AND SUMMARY OF THE INVENTION

Accordingly, it is an object of the invention to provide a one-dimensional tension mask-frame assembly for a CRT which is effective in reducing localized doming.

Another object of the invention is to provide such a tension mask-frame assembly which is simple of design and simple to construct.

In accordance with the invention, there is provided a one dimensional tension mask-frame assembly for a cathode ray tube comprising:

- a mask consisting of a relatively thin rectangular sheet defining a large number of apertures;
- a frame having two side members, a top member and a bottom member, at least the top and bottom members each having an upstanding portion having a spring constant, the upstanding portions each having a free edge, and at least one of the upstanding portions being flexed inwardly so as to have an outward spring bias; and
- the mask secured along the free edges of the upstanding portions of the top and bottom members of the frame.

By this arrangement, the mask is in a state of mechanical tension, and during thermal expansion of the mask, the at least one upstanding portion moves outwardly to maintain the mask in a state of mechanical tension.

In accordance with a preferred embodiment of the invention, the at least one upstanding portion having the outward spring bias has a plurality of substantially parallel slots spaced along the portion, thereby dividing the portion into sections, each having an outward spring bias. By this arrangement, each section can move independently of the other sections in response to localized thermal expansion of the mask. The number of slots may be as high as is consistent with needed mechanical strength, in order to allow the assembly to accommodate to local doming in areas as small as possible. In addition, the number of slots may increase toward the corners of the frame in order to allow increased accommodation to local doming toward the corners.

In accordance with another embodiment of the invention, the frame members each comprise an up-standing portion and a flange portion, the flange portions attached to one another at the corners of the frame, and the upstanding portions are at least partially separated from one another at the corners by, for example, notches.

In the presently preferred embodiment, the free edges of the top and bottom upstanding portions exhibit a convex curvature, resulting in a decreasing height of the upstanding portions from the centers along their lengths to the corners of the frame.

In accordance with another embodiment of the invention, there are one or more embossments in the upstanding portion to locally alter the spring constant of the upstanding portion.

The one-dimensional tension mask-frame assembly of the present invention is simple of design and simple to construct, and exhibits reduced doming, leading to increased color purity of CRTs employing them, and enables such CRTs to be driven at higher powers to achieve increased brightness. In addition, the sizes of the apertures of such masks can be increased, due to the reduced need for color purity reserve and the reduced need for structural strength of the mask, also resulting in increased brightness.

BRIEF DESCRIPTION OF THE DRAWINGS

The invention will now be described in terms of a limited number of embodiments with reference to the drawing, in which:

FIG. 4(*b*) is a section view similar to that of FIG. 4(*a*), showing the completed mask-frame assembly;

DESCRIPTION OF THE PREFERRED EMBODIMENTS

Color CRTs for color television produce an image display on a cathodoluminescent screen composed of a repetitive array of red, blue and green phosphor elements, by scanning the array with three electron beams from an electron gun in the neck of the CRT, one beam for each of the primary (red, blue and green) colors. The beams emanate from separate gun apertures, converge as they approach the screen, pass through an aperture of a mask positioned a short distance behind the screen, and then diverge slightly to land on the appropriate phosphor element. At a comfortable viewing distance, the human eye cannot resolve the individual red, blue and green elements in the screen, but rather integrates these primary colors to perceive additional colors produced by the primary colors.

Early CRTs for color television had screens composed of arrays of phosphor dots, but dot screens have been largely replaced by screens composed of arrays of vertically oriented phosphor stripes. As is known, such screens are primarily advantageous in alleviating the requirement for accurate registration between the mask and the screen in the vertical direction.

The masks for these striped screens are composed of vertically oriented columns of slot-shaped apertures separated from one another by so-called "bridges" or "tie-bars" of mask material, which tie the mask together to provide needed mechanical strength.

Figure 1:
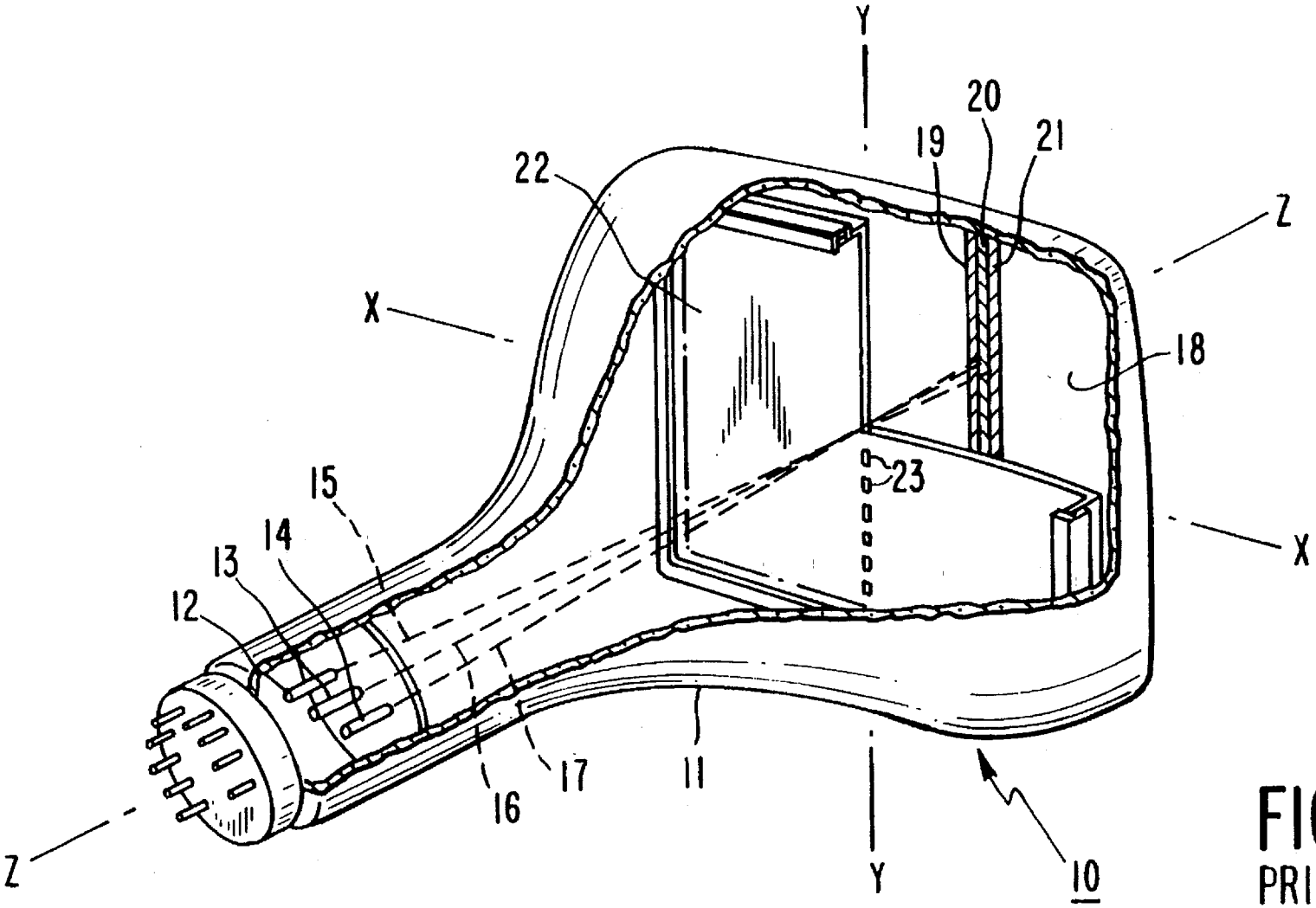
FIG. 1 PRIOR ART
FIG. 1 is a perspective view, partly cut away, of a color CRT employing a slotted aperture mask and a striped screen in accordance with the prior art.

Referring now to FIG. 1, color CRT 10 is composed of evacuated glass envelope 11, electron guns 12, 13 and 14, which direct electron beams 15, 16 and 17 toward screen 18, composed of alternating red, blue and green phosphor stripes, three of which, 19, 20 and 21 are shown. The beams 15, 16 and 17 converge as they approach apertured mask 22, then pass through vertical aperture column 23 and diverge slightly to land on the appropriate phosphor stripe 19, 20 or 21. Additional columns of apertures similarly correspond to additional stripe triplets, not shown. External deflection coils and associated circuitry, not shown, cause the beams to scan the mask and screen in a known manner, to produce a rectangular raster pattern on the screen.

Figure 2:
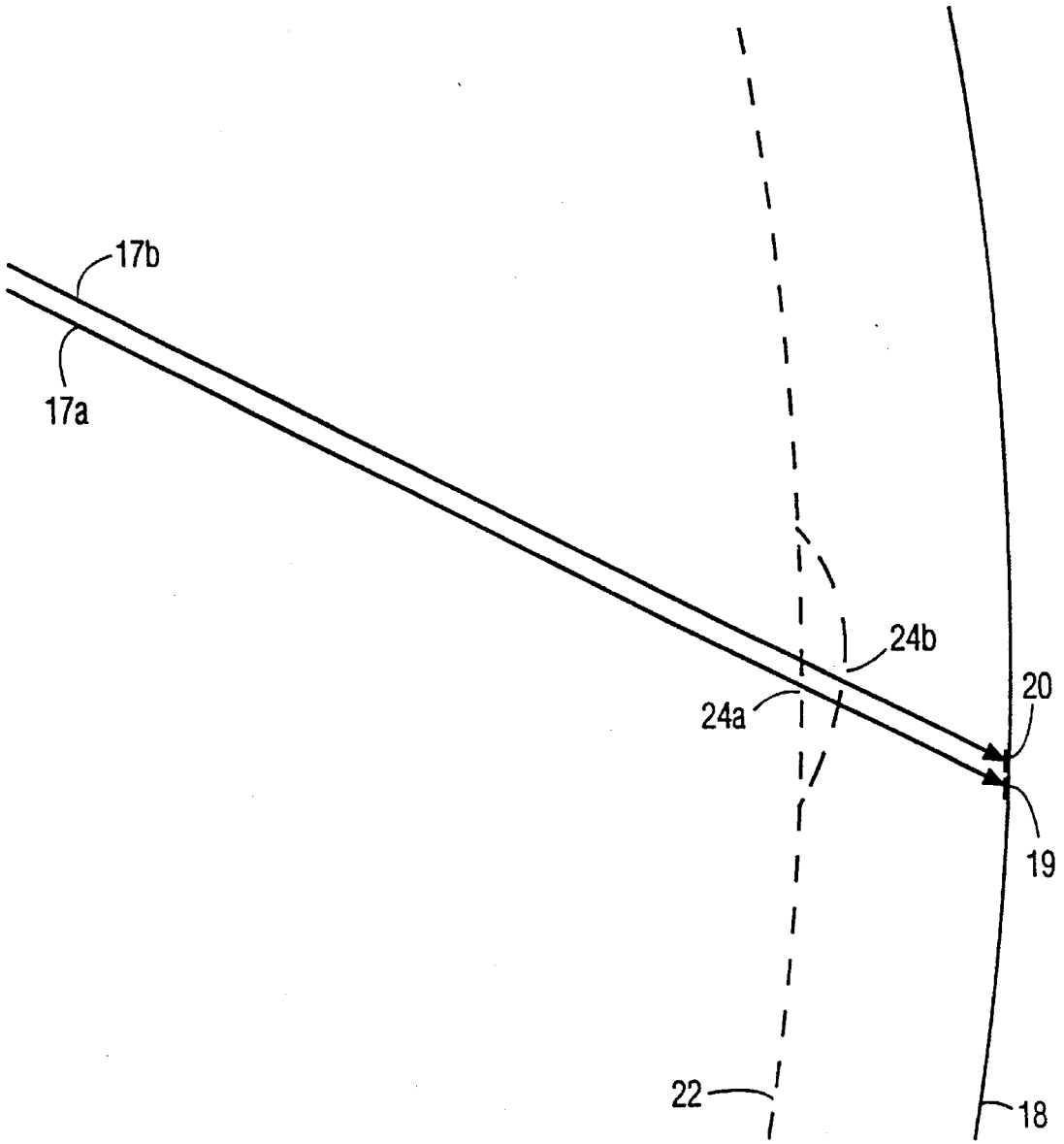
FIG. 2 is a schematic section view of portions of the mask and screen taken along the X axis of FIG. 1, illustrating the effect of doming on registration.

FIG. 2 shows the effect of localized doming on registration between the mask apertures and the phosphor stripes, and the effect on color purity of the display on the screen. Electron beam 17 initially follows path 17*a* to pass through aperture 24 at position 24*a* in mask 22 to land on the red phosphor stripe 19 on screen 18. Due to the effect of localized heating by the electron beams, a portion of mask 22 then bulges or "domes" outward, moving aperture 24 forward to position 24*b*, causing beam 17 to follow path 17*b* through aperture 24*b* to land on adjacent blue stripe 20. This degrades the color purity of the resultant display on the screen. One way of reducing the effect of such mis-registration is to reduce the size of the apertures, thereby increasing the "color purity reserve" i.e., the tolerance for beam landing errors. However, this reduces the mask transmission, and thus reduces the brightness of the display.

Figure 3:
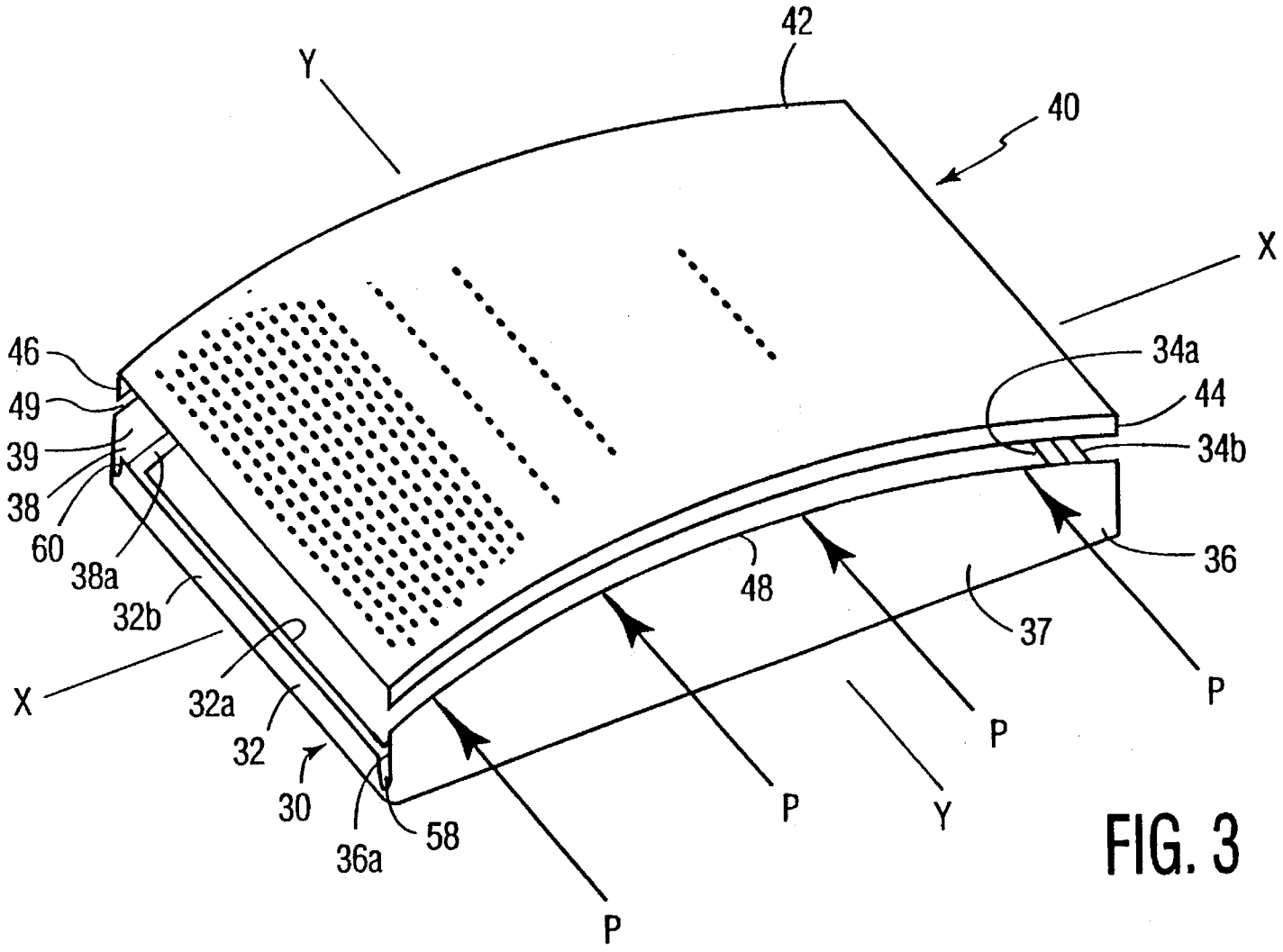
FIG. 3 is a perspective view of a slotted aperture mask and frame of the invention, prior to their assembly.
Figure 4A:
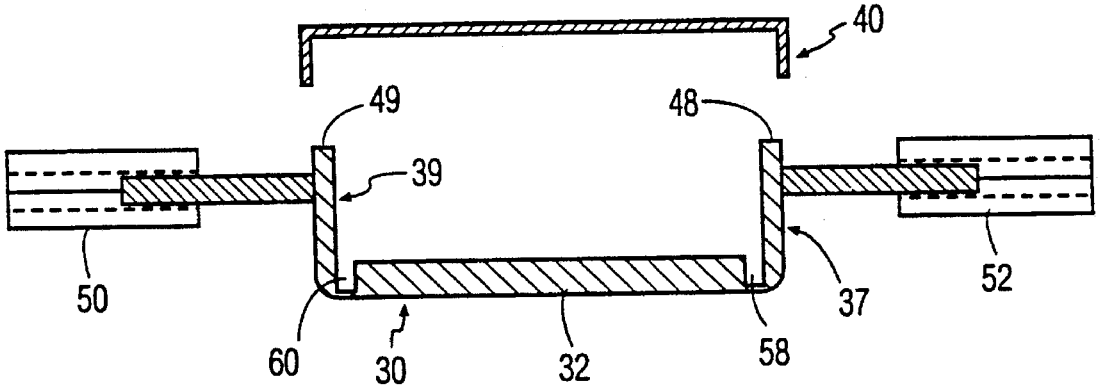
FIG. 4(*a*) is a section view of the mask and frame of FIG. 3, taken along the Y axis.
Figure 4B:
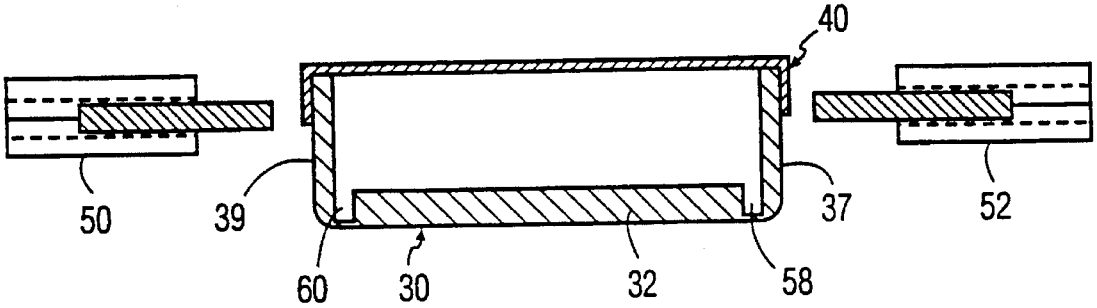

In accordance with the invention, such doming is reduced in a mask-frame assembly which maintains the mask in a state of tension in the vertical or Y axis direction. This is accomplished using a frame with top and bottom members having upstanding portions with a relatively low spring constant. FIG. 3 shows such a frame 30 composed of side members 32 and 34, and top and bottom members 36 and 38, including upstanding portions 37 and 39, respectively, ready for attachment to upstanding skirt portions 44 and 46 of mask 40. Prior to assembly, upstanding portions 37 and 39 are subjected to an inward pressure in the Y axis direction, as indicated by the arrows P in FIG. 3 and the air cylinders 50 and 52 in FIG. 4(*a*). As a result, portions 37 and 39 are flexed inwardly along their length. The mask 40 is then loaded onto the frame 30 and attached to the frame 30, after which the pressure from air cylinders 50 and 52 is removed, as shown in FIG. 4(*b*), allowing the portions 37 and 39 to flex outward, thus placing the mask 40 in tension. The mask 40 is attached to the frame 30 at or near free edges 48 and 49 of upstanding portions 37 and 39, by any suitable means, such as welding.

As shown in FIG. 3, the side, top and bottom members (32, 34, 36 and 38) of frame 30 each include a flange portion (32*a*, 34*a*, 36*a* and 38*a*), and an upstanding portion (32*b*, 34*b*, 37 and 39), respectively, and thus have an L-shaped cross-section. The flange portions are joined to one another at the corners of the frame to form a continuous substantially rectangular-shaped opening to allow passage of the electron beams to the central apertured portion 42 of mask 40. However, the upstanding portions are separated at the corners by notches, two of which, 58 and 60, are shown in FIGS. 3 and 4. These notches allow the upstanding portions 37 and 39 to flex independently without influence from the side members 32 and 34. The frame can be a single piece of 1006 low carbon steel, having a thickness of about 0.065 inch, and formed in the conventional manner by stamping.

The upstanding portions 37 and 39 exhibit decreasing height from their centers to the corners of the mask. This decreasing height imparts a desired curvature to the mask, and also results in an increasing spring constant of the upstanding portions from the center to the corners. In the case of an equal amount of inward displacement of the free edge along its length during assembly, this increasing spring constant from center to corners results in greater tension toward the edges of the mask. As will be appreciated from FIG. 2, there is no mis-registration due to doming at the center of the mask, since the center apertures move in line with the path of the electron beams. Thus, mis-registration begins off-center and in general increases as the angle the beam path makes with the mask surface decreases, i.e., as the distance from the center of the mask increases. The maximum effect has been observed to occur at about ⅔ the distance from the center to the edges of the mask in a conventional CRT.

EXAMPLE

A conventional 26 inch diagonal (26V) one-piece stamped steel frame having an approximately L-shaped cross-section, a thickness of 0.064 inch and a maximum height of the upstanding portions of the top and bottom members of 2.35 inches, was modified by forming notches in the corner regions to separate the upstanding top and bottom portions from the upstanding side portions. These upstanding side portions had a spring constant of approximately 41 pounds/inch per linear inch of width of the upstanding portions. A conventional 26 inch diagonal (26V) flat steel aperture mask having a thickness of 0.0065 inch, and a central apertured portion surrounded by side, top and bottom borders, was modified by removing the side borders and by forming the top and bottom borders into upstanding skirts in a manner to result in a mask height slightly less than the height of the frame. The top and bottom upstanding portions of the frame were pressed inward, resulting in the free edges of the top and bottom upstanding portions each being deflected inward by an amount of about 0.46 inch, and the mask skirts were attached to the frame using screws. This resulted in an approximate tension of 19 pounds per linear inch width of the aperture mask. Since the total width of the mask was 20 inches, the approximate total tension in the mask was 380 pounds.

Mis-registration due to doming was measured on two sample mask/frame assemblies prepared as described above, and one standard 26V assembly representative of the prior art, by the following procedure. The assembly to be tested was fixtured on an optical table. A collimated light beam was passed through the aperture array in the doming region (about ⅔ the distance from center to edge) of the mask, essentially parallel to the path of an electron beam in an operating tube. After passing through the apertures, the beam fell on a simulated screen, having ruled lines representing phosphor stripes, fixtured so it was at approximately the same position as the real screen in an operating tube. A moiré pattern was formed on the simulated screen. This moiré pattern was observed by a video camera. The aperture mask was heated locally by a heat gun, causing the mask to expand. As the mask expanded, the temperature rise of the mask was measured with a thermocouple and doming was observed as a motion of the moiré pattern. Using the pitch of the aperture mask, the pitch of the simulated screen, and the angle at which the light beam struck the mask, and the motion of the moiré pattern, the motion of the mask perpendicular to it's surface, that is, the amount of doming induced by the local heating, was calculated. The calculated value for the standard 26V assembly was 00029"/° F. compared to a theoretical value for a simple model of 0.00034"/° F. The average value of the two assemblies produced in accordance with the invention was 0.00014"/° F. Thus, the doming of a mask assembly produced according to this invention had approximately half the doming of an assembly produced according to the prior art.

Figure 5:
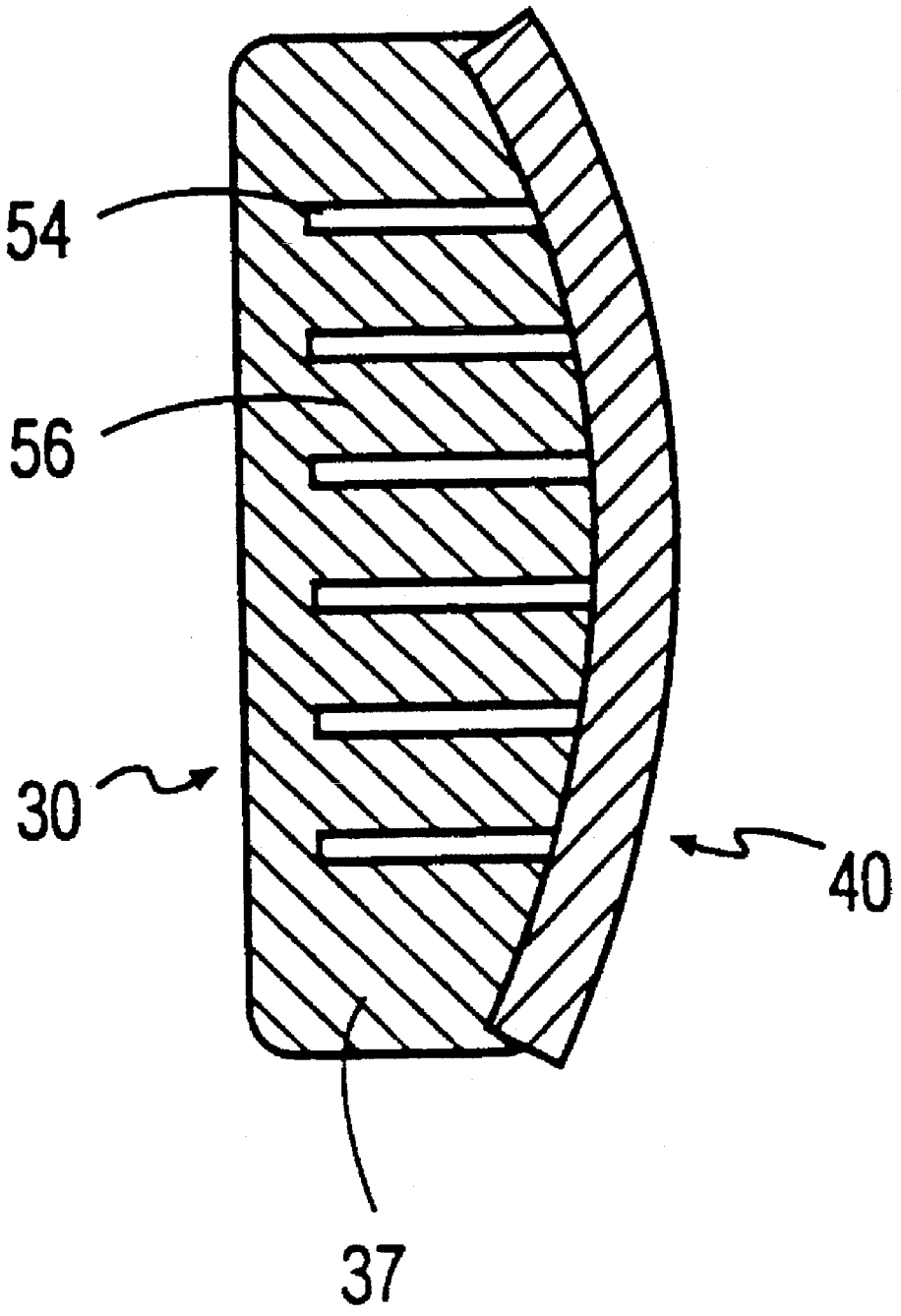
FIG. 5 is a top view of another embodiment of a mask-frame assembly in accordance with the invention.

FIG. 5 shows another embodiment of the mask-frame assembly of the invention, in which the upstanding portions 37 (and 39, see FIG. 4) have been divided into sections 56 by a series of slots 54, resulting in the ability of the individual sections to flex independently of one another in response to local doming. In the embodiment shown, the height of the upstanding portion 37 decreases from its center to the corner of the frame, and the slots all extend to a depth such that the ends of the slots 54 are equidistant from the bottom, fixed edge of the upstanding portion. Thus, the sections 56 exhibit decreasing length and increasing spring constant from the center to the corners. The depth of the slots could of course all be the same, in which case the spring constants of the sections would all be the same. Increasing the number of slots, and therefor the number of sections, consistent with maintaining required mechanical strength, would be advantageous in that it would increase the ability of the assembly to accommodate smaller areas of local doming.

Figure 6A:
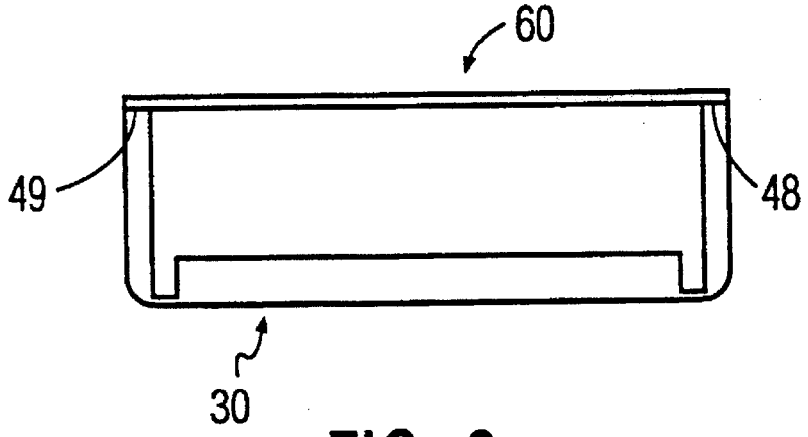
FIGS. 6(*a*) through (*c*) show other embodiments of the mask and the upstanding portions of the frame of the invention.
Figure 6B:
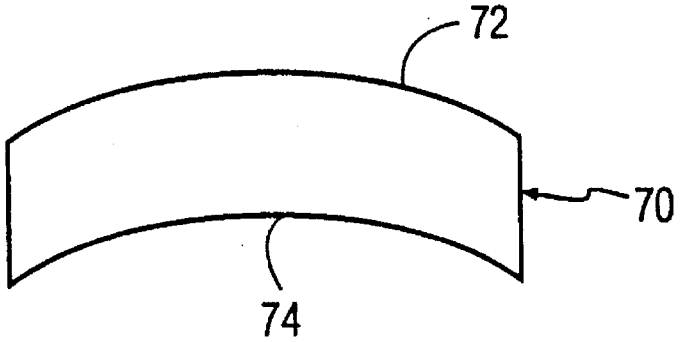
Figure 6C:
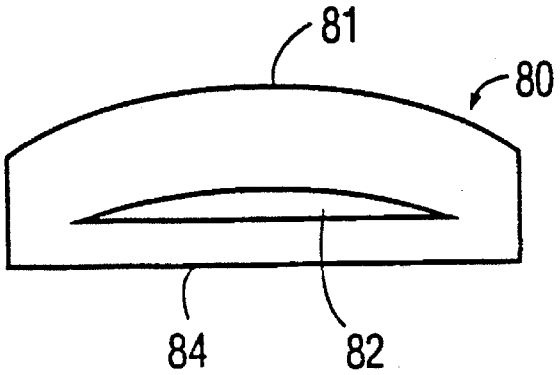

FIGS. 6(*a*) through (*c*) show various additional possible embodiments of the invention. FIG. 6(*a*) shows a section view taken along the Y axis of a mask-frame assembly in which the mask 60 is attached at its top and bottom edges to the free edges 48 and 49 of frame 30, for example, by laser spot welding. This embodiment has the advantage that the mask has no upstanding skirt, and is therefor easier to form and easier to handle during assembly.

FIG. 6(*b*) shows upstanding frame portion 70 having a curved free edge 72 similar to those of the previously described embodiments, but having a constant height, achieved by also curving the bottom fixed edge 74. This embodiment has the advantage that the spring constant is invariant along the length of upstanding portion 70.

FIG. 6(*c*) shows upstanding frame portion 80 having a curved free edge 81 and straight bottom edge 84 similar to those of previously described embodiments, but also having a portion 82 which may be an embossment or an attached part, shaped to result in an invariant spring constant along the length of the upstanding portion 80.

The invention has been described in terms of a limited number of embodiments. Other embodiments and variations of embodiments will be readily apparent to the skilled artisan, and are thus intended to be encompassed within the scope of the appended claims.

For example: the free edge of the upstanding portion may be straight rather than curved, or even a composite edge of straight and/or curved portions. Only one of the two upstanding portions need to be flexed in order to provide the needed tension in the mask; the frame members may have a straight, round, C-shaped or other cross-section, in place of the L-shaped cross-section shown; the embossments or attachments may be divided into sub-parts and distributed in any manner to achieve the desired alteration of the spring constant.

What I claim as my invention is:

1. An aperture mask-frame assembly for a cathode ray tube comprising:

a mask consisting of a relatively thin sheet defining a large number of apertures;

a frame comprising two side members, a top member and a bottom member; the members jointed at four corners; at least the top and bottom members each comprising an upstanding portion having a spring constant, the upstanding portions each having a free edge, the upstanding portions of the top and bottom members separated at the corners from the side members, so that the upstanding portions can flex independently without influence from the side members, and at least one of the upstanding portions being flexed inwardly so as to have an outward spring bias;

the mask secured along the free edges of the upstanding portions of the top and bottom members of the frame;

whereby the mask is in a state of mechanical tension, and during thermal expansion of the mask, the at least one upstanding portion moves outwardly to maintain the mask in a state of mechanical tension.

2. The mask-frame assembly of claim 1 in which the at least one upstanding portion having the outward spring bias has a plurality of substantially parallel slots spaced along the portion, thereby dividing the portion into sections, each having an outward spring bias, whereby each section can move independently of the other sections in response to localized thermal expansion of the mask.

3. The mask-frame assembly of claim 1 in which the frame members each comprise an up-standing portion and a flange portion, the flange portions attached to one another at the corners of the frame, and the upstanding portions at least partially separated from one another at the corners.

4. The mask-frame assembly of claim 3 in which the upstanding portions are at least partially separated from one another by notches.

5. The mask-frame assembly of claim 1 in which the free edges of the top and bottom upstanding portions exhibit a convex curvature, resulting in a decreasing height of the upstanding portions from the centers of the upstanding portions to the corners of the frame.

6. The mask-frame assembly of claim 5 in which the at least one upstanding portion having the outward spring bias has a plurality of substantially parallel slots spaced along the portion, thereby dividing the portion into sections, each having an outward spring bias, whereby each section can move independently of the other sections in response to localized thermal expansion of the mask.

7. The mask-frame assembly of claim 5 in which there are one or more embossments or attached parts in at least one of the upstanding portions to locally alter the spring constant of the upstanding portion.

8. The mask-frame assembly of claim 6 in which the spacing between the slots increases from the center of the upstanding portion to the corners of the frame.

9. The mask-frame assembly of claim 3 in which the frame members are integral portions of a one-piece stamped frame.

10. The mask-frame assembly of claim 9 in which the free edges of the top and bottom upstanding portions exhibit a convex curvature, resulting in a decreasing height of the upstanding portions from the centers of the upstanding portions to the corners of the frame.

11. The mask-frame assembly of claim 10 in which the at least one upstanding portion having the outward spring bias has a plurality of substantially parallel slots spaced along the portion, thereby dividing the portion into sections, each having an outward spring bias, whereby each section can move independently of the other sections in response to localized thermal expansion of the mask.

12. The mask-frame assembly of claim 10 in which there are one or more embossments or attached parts in at least one of the upstanding portion to locally alter the spring constant of the upstanding portion.

13. The mask-frame assembly of claim 11 in which the spacing between the slots increases from the center of the upstanding portion to the corners of the frame.

* * * * *